US005388686A

United States Patent [19]

Kanner et al.

[11] Patent Number: 5,388,686

[45] Date of Patent: Feb. 14, 1995

[54] LENS CASE FOR CONTACT LENS DISINFECTING SYSTEM

[75] Inventors: Rowland W. Kanner, Guntersville; Stephen P. Lisak, Arab, both of Ala.

[73] Assignee: Ryder International Corporation, Arab, Ala.

[21] Appl. No.: 105,749

[22] Filed: Aug. 12, 1993

Related U.S. Application Data

[63] Continuation-in-part of Ser. No. 13,812, Feb. 2, 1993, abandoned.

[51] Int. Cl.[6] ..... B65D 85/38

[52] U.S. Cl. ..... 206/5.1; 206/210; 134/901; 220/289

[58] Field of Search ..... 206/5 R, 5.1, 210; 220/289; 134/901

[56] References Cited

U.S. PATENT DOCUMENTS

| | | | |
|---|---|---|---|
| 2,117,404 | 5/1938 | Davis | 220/289 |
| 3,519,005 | 7/1970 | Krezanoski et al. | 206/5.1 |
| 3,770,113 | 11/1973 | Thomas | 206/5.1 |
| 3,964,926 | 6/1976 | Westphal | 206/5.1 |
| 4,011,941 | 3/1977 | Parsons | 206/5.1 |
| 4,109,820 | 8/1978 | Stifano | 220/289 |
| 4,257,521 | 3/1981 | Poler | 206/5.1 |
| 4,807,750 | 2/1989 | Ryder et al. | 206/5.1 |
| 4,890,729 | 1/1990 | Ranalletta | 206/5.1 |
| 4,956,156 | 9/1990 | Kanner et al. | 206/5.1 |
| 5,186,317 | 2/1993 | Ryder et al. | 134/901 |
| 5,196,174 | 3/1993 | Cerolo et al. | 206/5.1 |

*Primary Examiner*—Paul T. Sewell
*Assistant Examiner*—Marie Denise Patterson
*Attorney, Agent, or Firm*—Trexler, Bushnell, Giangiorgi & Blackstone

[57] ABSTRACT

A contact lens case includes a cup adapted to receive a quantity of disinfecting or cleaning solution and a cap removably closing the opening mouth of the cup. A lens support structure is associated with the cap and holds a pair of lenses within the cup. The lens support structure includes a base plate which supports one of a pair of the lenses on each side thereof and basket means pivotally connected to the base plate for enclosing the lenses in overlying position and maintaining the lenses on the base plate. A latch structure releasably maintains the basket means in the overlying position, and includes a flexible, integral extension peripherally formed on each basket means and is releasably retained in the overlying position by snap-fit against a hook member. Preferably, a pair of the flexible extensions are formed as vertically aligned and thinned tabs on opposing edges of each basket, which are snap-fit against a corresponding pair of hooks formed on each side of the lens support structure. The latches for each basket are paired to prevent any slippage of the lens from the correctly centered position on the base plate which could lead to pinching of the lens during snap-fit opening or closing of the respective basket.

23 Claims, 5 Drawing Sheets

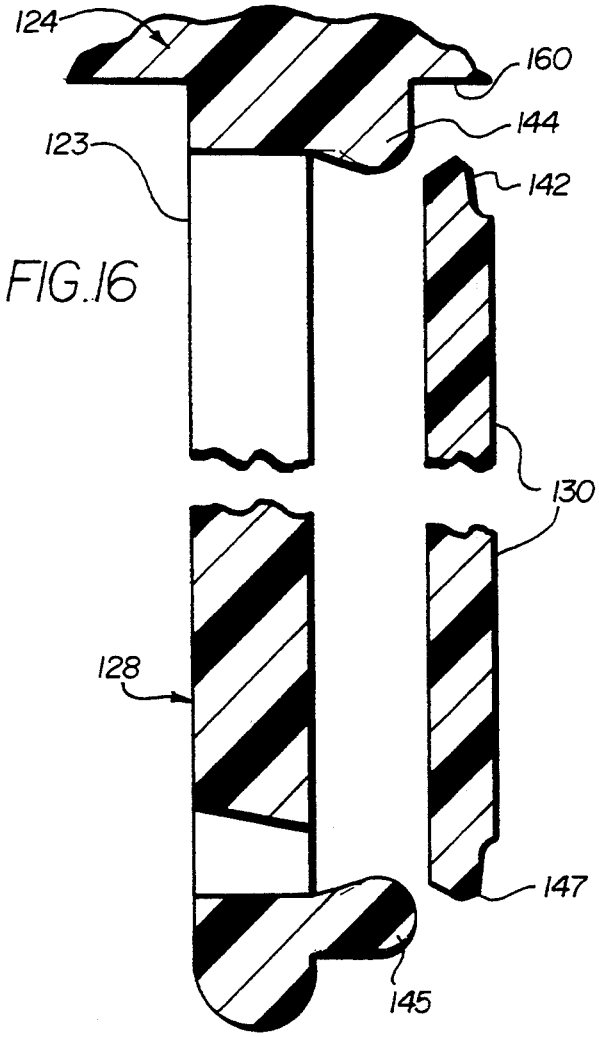
FIG.16
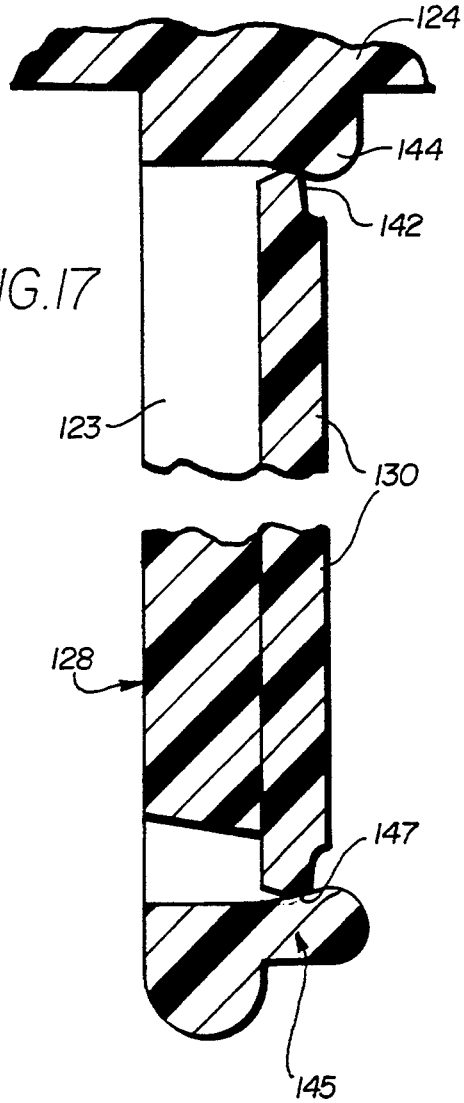
FIG.17
FIG.18
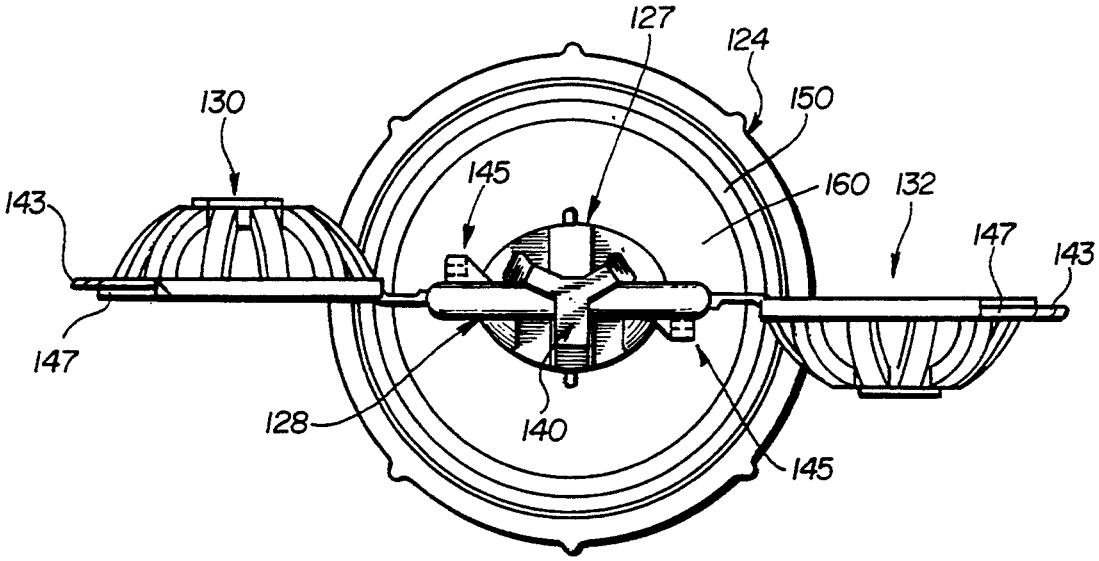

LENS CASE FOR CONTACT LENS DISINFECTING SYSTEM

CROSS REFERENCE TO RELATED APPLICATION

This application is a continuation-in-part of application Ser. No. 08/013,812, filed Feb. 2, 1993, now abandoned.

BACKGROUND OF THE INVENTION

This invention relates to improved storage and holding containers for small articles, particularly contact lens cases, adapted to contain solutions in which the contact lenses are immersed for disinfecting or cleaning.

The widely-used soft contact lenses require protective storage containers which may also be used for disinfecting treatment of the lenses. Numerous commercially successful storage and disinfecting lens containers have been developed such as those described in U.S. Pat. Nos. 4,637,919 and 4,750,610 in which each lens of the pair is separately supported in a basket-like enclosure which is releasably latched in a closed or storage position and opens for access to the lens. Typically, the lenses are disinfected by immersion in a hydrogen peroxide solution. The hydrogen peroxide solution will have a strength of about which is sufficient to destroy most harmful bacteria. The system also employs a catalyst to decompose the hydrogen peroxide solution, into water and liberated oxygen. The resulting liberated oxygen requires a vent structure in order to prevent excessive pressure build-up within the lens case vessel. The end result, following decomposition of the hydrogen peroxide and venting of the liberated oxygen, is that no pressure remains in the lens case and the hydrogen peroxide ($H_2O_2$) has been converted to water.

The invention in accordance with the present application provides multiple improvements in the design of a lens case and solution container employed for lens disinfection.

SUMMARY OF THE INVENTION

In accordance with the present invention, a contact remnants case includes a cup adapted to receive a quantity of disinfecting or cleaning solution and a cap removably closing the opening mouth of the cup. A lens support structure is associated with the cap and holds a pair of lenses within the cup. The lens support structure includes a base plate which supports one of a pair of the lenses on each side thereof and basket means pivotally connected to the base plate for enclosing the lenses in overlying position and maintaining the lenses on the base plate. A latch structure releasably maintains the basket means in the overlying position, and includes a flexible, integral extension peripherally formed on each basket means and is releasably retained in the overlying position by snap-fit against a hook member laterally projecting from the support structure. Preferably, a pair of the flexible tabs are formed from vertically aligned and thinned notches on opposing edges of each basket, which are snap-fit against a corresponding pair of hooks. The latches for each basket are paired to prevent any slippage of the lens from the correctly centered position on the base plate which could lead to pinching of the lens during snap-fit opening or closing of the respective basket. The upper hook can extend from the lower surface of the cap in order to promote spacing of the upper latch from the base plate and supported lens.

In a preferred embodiment, the cap is integrally formed with the base plate and both of the baskets are connected by integral, "live hinges" to the base plate so that the molded cap assembly and the cup are the only two pieces required for the lens case. The cup is provided with one or more sealing rings which bite into the cap in a closed position thereof to ensure sealed containment of the disinfecting solution and processing vertically spaced below threaded coupling of the cap upon the cup. Since the cap and lens support structure is an integral one-piece construction, a pair of mold parting line flash lenses are formed on the sealing surface of the cap. The sealing ring or rings will deform or cut into these flash lines to insure a proper seal. Further, while the cup is formed of a plastic material that is harder than that used on the cap, as explained hereinafter, to insure a good seal, the plastic material selected for the cap will permit the cup to expand slightly under pressure. This expansion is such that excessive pressure build-up within the cup will be vented past the sealing rings. That is to say, the sealing rings enable elastic circumferential expansion away from the cap to intermittently relieve elevated pressure by allowing gaseous, self-regulated venting therebetween.

Other aspects of the invention include a base plate having a lens support surface which is surrounded by an annular pattern of through apertures which intersect the circumference of a lens upon the support surface so that the apertures prevent development of a fluid seal and suction action during storage and facilitate removal of the lens from the support surface. Additionally, the base plate can include an integrally extended coupler for mounting a conventional catalyst element thereon, in which the coupler includes a barbed-like retainer which prevents removal of the catalyst from the coupler once assembled.

BRIEF DESCRIPTION OF THE DRAWINGS

FIG. 16 is an enlarged, fragmentary view of a latch structure which retains the closed position of the basket portions against the base portion of FIG. 15, shown just prior to latching engagement;

FIG. 17 is a fragmentary, sectional view similar to FIG. 16 showing the completed latch engagements; and FIG. 18 is a bottom, plan view of the integral cap and lens support structure as shown in FIG. 13.

DETAILED DESCRIPTION OF THE ILLUSTRATED EMBODIMENT

Figure 1:
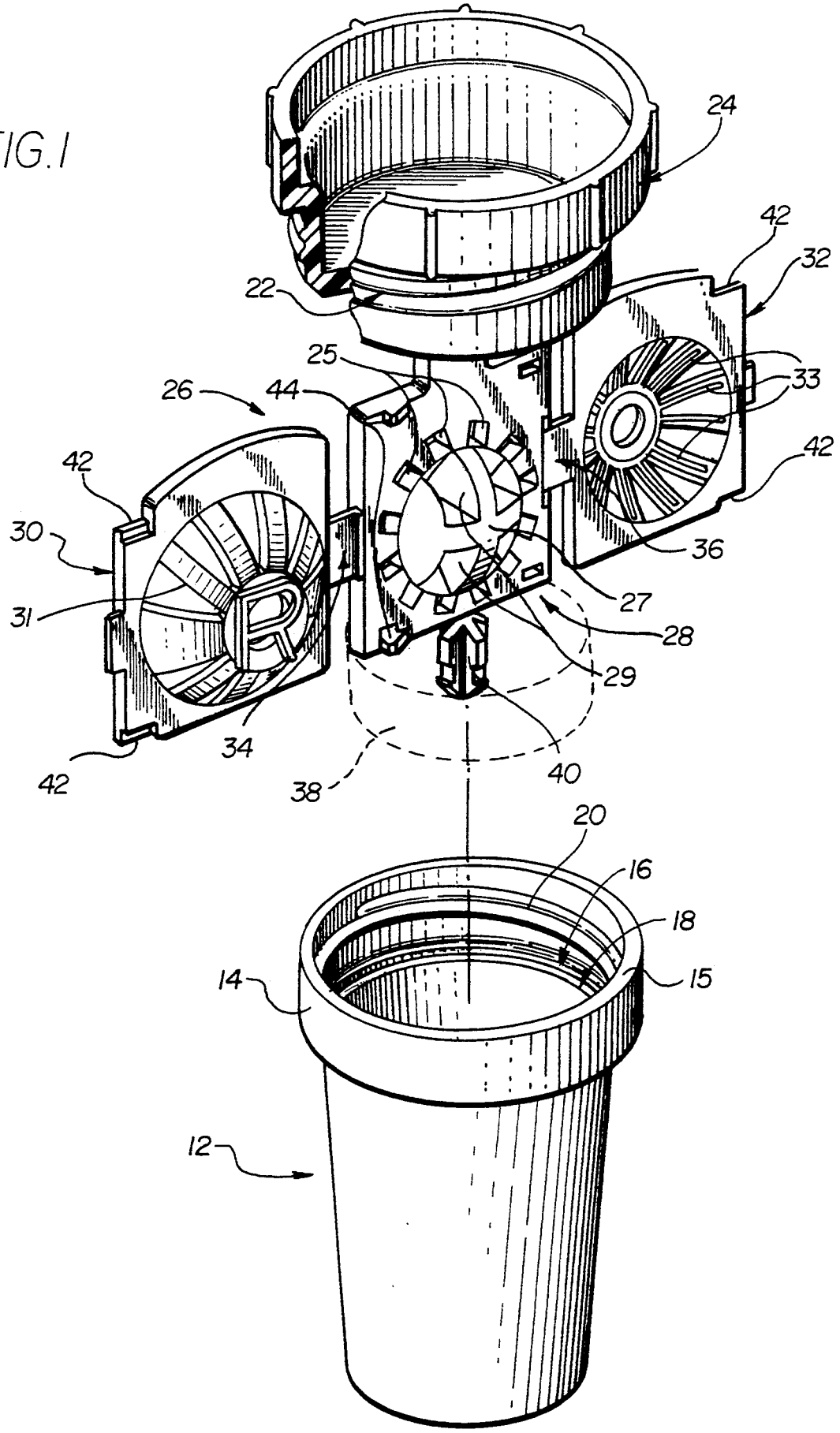
FIG. 1 is an exploded perspective view of one embodiment of a lens case or container in accordance with the present invention.
Figure 2:
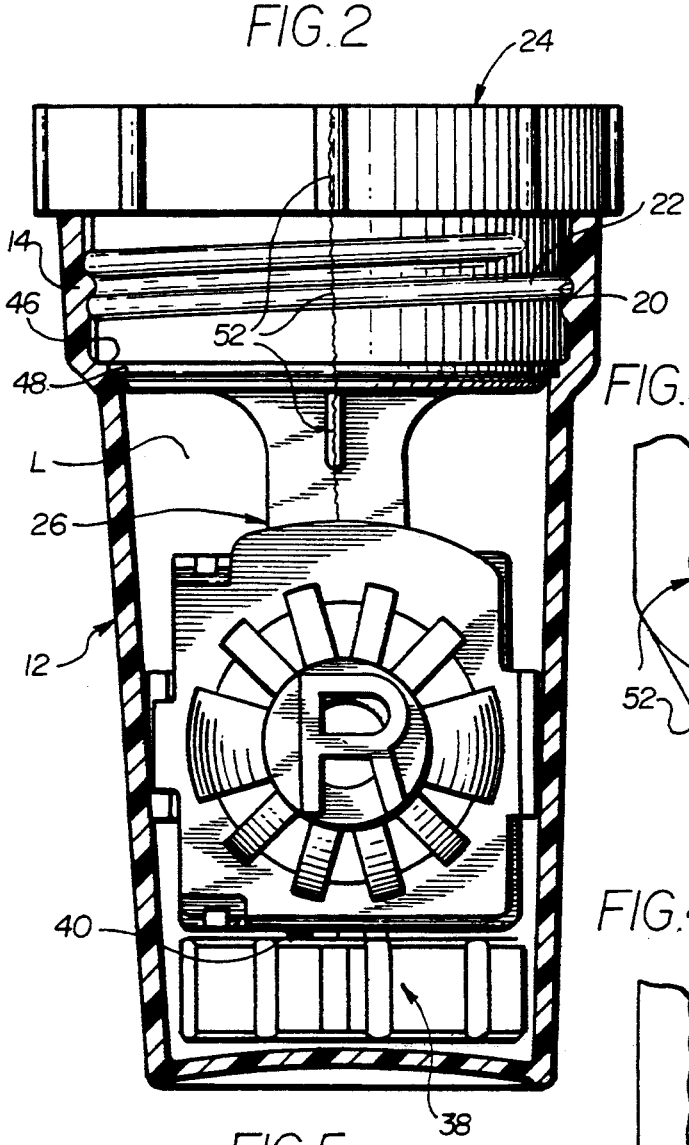
FIG. 2 is a partially sectional view of the assembled lens case shown in FIG. 1.

Initially referring to FIGS. 1 and 2, a first embodiment of a contact lens case in accordance with the invention is illustrated and generally designated by a reference character 10. The lens case 10 comprises a container or cup 12 with a general cylindrical body and an upper collar portion thereof 14 which defines an open mouth or upper rim 15, and which facilitates molding of internal, annular sealing rims or shoulders 16 and 18 which provide fluid seals as more fully described hereinafter. Above the shoulders 16 and 18 are internal threads 20 which receive mating threads 22 on a removable screw cap 24 which closes the end opening of the collar 14 as shown in FIG. 2.

Referring again to FIG. 1, the cap 24 is preferably molded integrally with a lens-supporting basket assembly generally designated by a reference character 26 which projects downwardly into the container 12 when the cap 24 is mounted thereon. The lens support basket assembly 26 includes a base plate 28 which supports one of a pair of contact lenses A (FIG. 6) on each side thereof, and has a structure more fully described in detail hereinafter. The base plate 28 is centrally located between hinged lens covers 30 and 32 which have a perforated, basket-like configuration to enable disinfecting or cleaning solution within the cup 12 to diffuse or pass through the basket-like covers and immerse the lenses. Each basket-like cover 30,32 has raised interior ribs 31,33 which protect the lens by spacing them from any hazardous molding flash remnant as more fully described in U.S. Pat. No. 4,981,657 the disclosure of which is incorporated by reference herein.

The covers 30 and 32 are connected to the base plate 28 by integral, attenuated hinge portions or "live hinges" 34 and 36. The integral hinges 34 and 36 enable the respective covers 30 and 32 to pivot to a closed position engaged against the base plate 28 on respective opposite sides, and to releasably enclose respective lenses while allowing access for separate insertion or removal of each lens.

Figure 5:
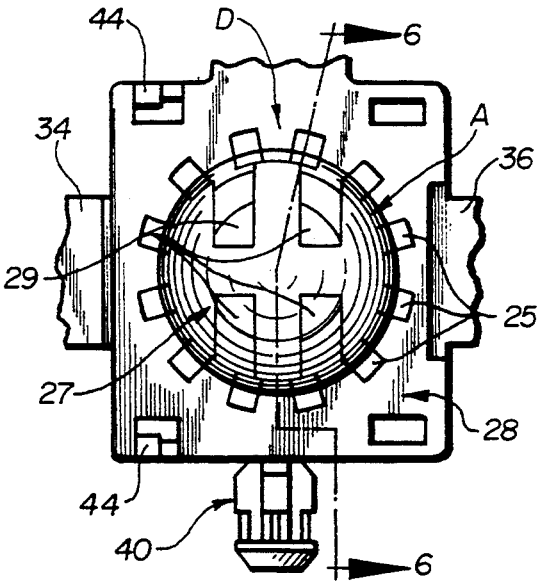
FIG. 5 is a fragmentary, plan view of a lens-supporting base portion of the lens case shown in FIGS. 1 and 2.
Figure 6:
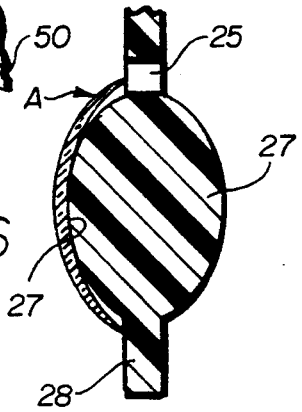
FIG. 6 is a sectional view along a plane indicated by line 6—6 in FIG. 5.

The base plate 28 itself has a pair of opposing button-like convexed surfaces 27 which both share common through perforations 29 to enable enhanced solution flow therethrough and cleansing diffusion behind the lenses for thorough disinfection. Surrounding the convex surfaces 27 is an annular pattern of through apertures 25 which together with the perforations 29 promote perimeter breathing around the lens so that removal of the lens from the surface 27 is not impeded by any fluid sealing tendency for a suction action or vacuum development when the cap 24 and basket assembly 26 have been withdrawn from the solution in cup 12 and the covers 30 and 32 have been opened for lens access. As best shown in FIGS. 5 and 6, accordingly, the annular arrangement of the apertures 25 defines a maximum diameter D larger than the circumference of the average contact lens diameter, for example 13–17 mm. The combination of the perforations 29 and apertures 25 also promote drainage of previously used and exhausted solution to minimize contamination through carry-over into a new disinfection cycle.

As shown in FIG. 2, with the cup and cap assembled, the lens supporting basket assembly 26 extends below the sealing rims or shoulders 16 and 18 and the disinfecting or cleaning solution is dispensed into the cup 12 only to a level L below the shoulders 16 and 18 which form a fluid seal above the immersed contact lenses but below the mating cup and cap threads 20,22. The threads 20,22 are thus isolated from any hydrogen peroxide solution spatter which may be created during the disinfection process particularly where gaseous turbulence is developed such as in oxygen liberation by decomposition of the hydrogen peroxide promoted by a typical catalyst element 38. As a result, the cleansing solution, particularly hydrogen peroxide, cannot drip from the threads onto the lenses nor create an eye irritation hazard therefrom. The catalyst element 38 is mounted on a coupler 40 integrally molded below the base plate 28 as more fully described hereinafter.

Figure 7:
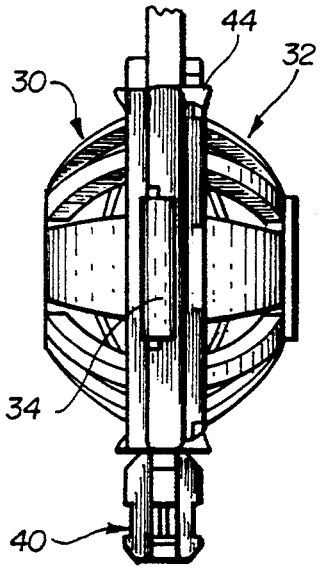
FIG. 7 is a fragmentary, side elevational view of basket portions closed against the lens supporting base portion as shown in FIG. 5.
Figure 8:
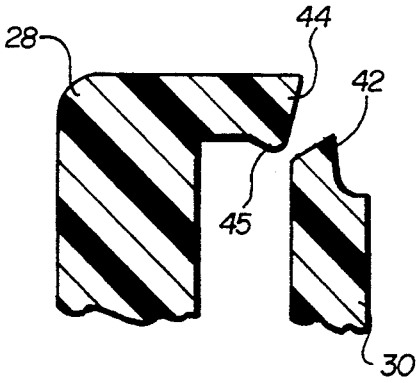
FIG. 8 is an enlarged, fragmentary view of a latch structure which retains the closed position of the basket portions against the base portion, Shown just prior to latching engagement.

In order to retain the closed position of the cover members 30 and 32 as shown in FIGS. 2 and 7, a latch structure is provided by a pair of attenuated or thinned and flexible tabs 42 integrally extending from each cover member at outside corners thereof (see FIG. 1) which cooperate with a pair of respective hook members 44 laterally projecting from base plate 28 to snap-fit over and releasably retain the tabs 42 and the closed, overlying position of the cover upon the base plate 28. In the illustrated embodiment, the attenuated tabs 42 are formed as corner notches by mold inserts of variable tolerance to allow height adjustment for latch tightness and to compensate for mold wear. The tabs 42 are vertically aligned on opposing edges of the cover so that there can be no upper or lower gap in the closed position of the respective cover 30 or 32 which could allow migration or slippage of the lens A from the correctly centered position on the support surface 27 particularly during handling to insert or withdraw the support structure 26 from the cup 12, which could lead to pinching of the lens for example during snap-fit opening or closing of the respective cover member 30,32.

Figure 9:
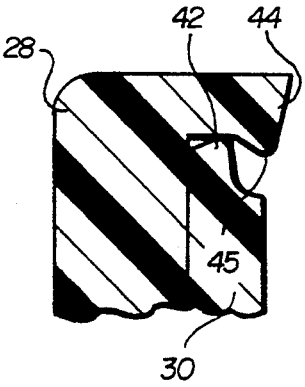
FIG. 9 is a fragmentary, sectional view similar to FIG. 8 showing the completed latching engagement.
Figure 10:
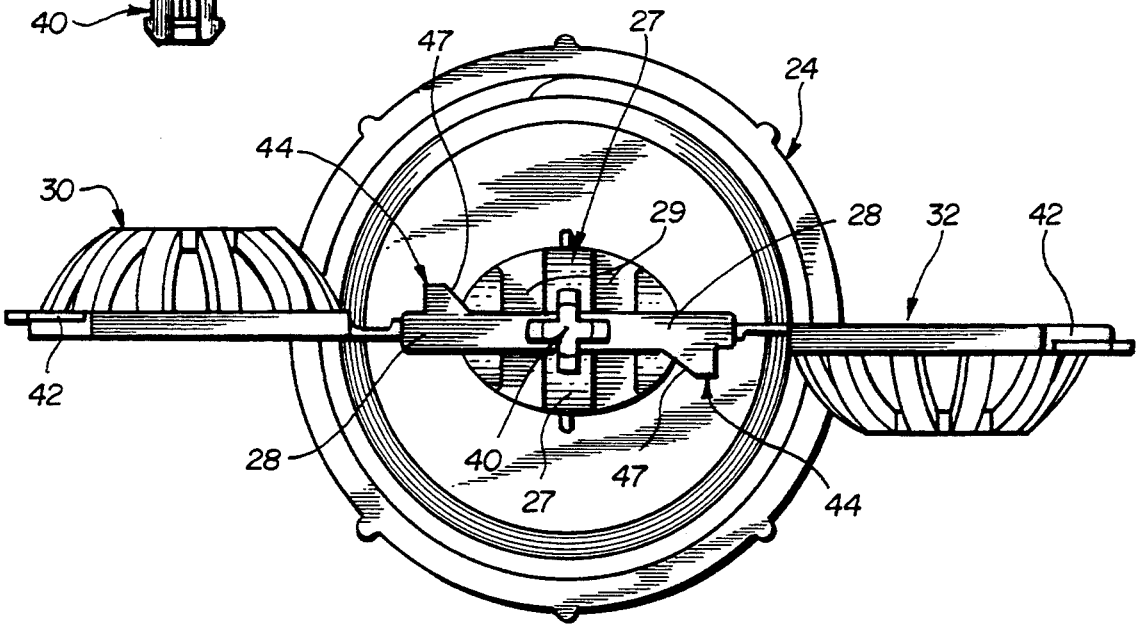
FIG. 10 is a bottom, plan view of the integral cap and lens support structure as shown in FIG. 1.
Figure 11:
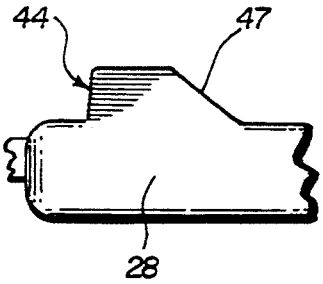
FIG. 11 is an enlarged, fragmentary view of the latching hook shown in FIGS. 8–10.

The hook members 44, which are best understood from FIGS. 8–11, are paired to project from a respective side of the base plate 28 and positioned in adjacent corners thereof and remote from the support surface 27 and lens, as best shown in FIGS. 10 and 11. The hook surface 45 (FIG. 8) will engage the tab 42 to lock the member in engagement (FIG. 9). The surface of the hook member at right angles thereto, and which is most proximate to a lens supported on the surface 27, has a configuration sloping away from the surface 27 and is designated 47 in order to lead the surface of a misguided lens smoothly across the hook member 44 if inadvertently the lens is displaced from the support means against the hook member so that any lens damage by the hook is prevented. That is to say, as a lens is removed from the convex support 27, which is usually a sliding action, no sharp corners are presented by hook members 44 which could damage the lenses.

Figure 3:
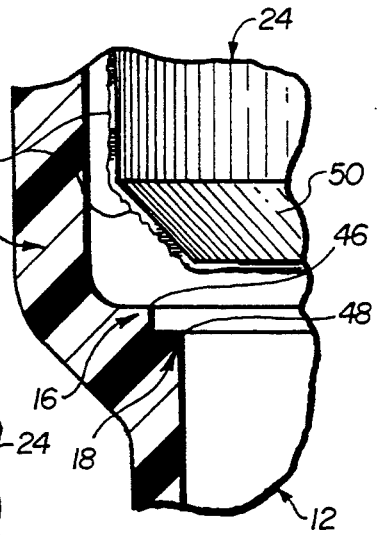
FIGS. 3 and 3A are enlarged, fragmentary, partially sectional views of a sealing portion of a cup wall and cap in the lens case of FIGS. 1 and 2.
Figure 4:
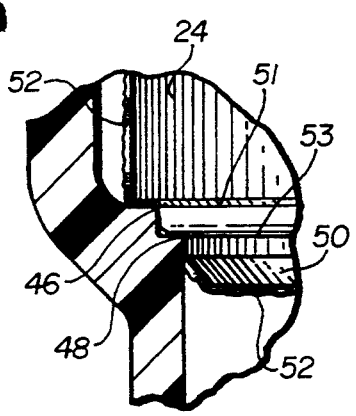
FIG. 4 is a sectional view similar to FIG. 3 showing sealing of the cup wall against the cap of the lens case.

Referring again particularly to FIGS. 3 and 4, sealing configuration of the present invention will now be considered. In this regard, each of the shoulders 16 and 18 has a sharp annular edge 46 and 48 respectively which bite or cut grooves 51 and 53 into and form a seal against an inwardly tapered, conical leading surface 50 of the cap 24 as the cap 24 is twisted into fully threaded, closed position as illustrated in FIGS. 2 and 4. In the illustrated embodiment, two shoulder seals 16 and 18 are provided although optionally a single shoulder seal may be employed if sealing is sufficient. The biting seal by the shoulders 16 and 18 is facilitated by molding the cap 24 from a softer resin than the molded resin of the cup 12 and shoulders 16 and 18. For example, the cap 24 (and integrally formed basket assembly 26) can be molded from a low density polypropylene such as El Paso Rexene® Polypropylene (R80 Rockwell Hardness) relative to molding of the cup 12 from high density polypropylene, for example Eastman Tenite® Polypropylene (R97 Rockwell Hardness) or Shell 6C Polypropylene (R84 Rockwell Hardness). As mentioned previously, the cup 12 must be sufficiently flexible to expand under internal pressure to relieve any pressure build-up that results from the liberated oxygen during decomposition.

Figure 3A:
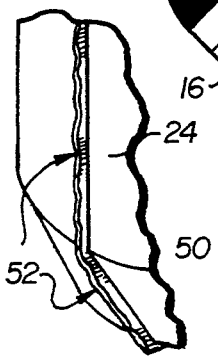
Figure 4A:
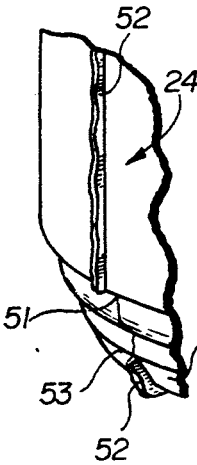
FIG. 4A is an enlarged, fragmentary view of the sealing impression formed in the cap by the sealing cup shown in FIG. 4.

When the cap 24 and basket assembly 26 are integrally molded, the unavoidable mold parting flash line 52 will result. The mold flash parting line 52 will extend the length of the cap/lens support assembly 12/26 and will be on opposite sides thereof. Most importantly, a portion of the flash parting line 52 will extend across the tapered sealing surface 50 (see FIG. 3A). The presence of this flash parting line can adversely affect the sealing action. To overcome this, the shoulders 16 and 18 with their respective sharp edges 46 and 48 formed from a harder material than the flash line 52, will cut through the flash line to insure attainment of a proper seal. More specifically, the sharp shoulder edges 46 and 48 cut their own mating grooves 51 and 53 into the softer conical cap surface 50 so that the fluid seal is perfected despite the parting flash line 52 which has been cut or interrupted (FIG. 4A) by the edges 46 and 48 as well as compressed at 49 by the harder shoulders 16 and 18. Furthermore, elevated pressure generated by gaseous oxygen liberated from the decomposed hydrogen peroxide in the disinfecting solution, can be vented through elastic circumferential expansion of the cup 12 and shoulders or sealing rims 16 and 18, for example at an internal pressure of approximately 20 psi, so that excessively high pressure cannot develop within the lens case.

Figure 12:
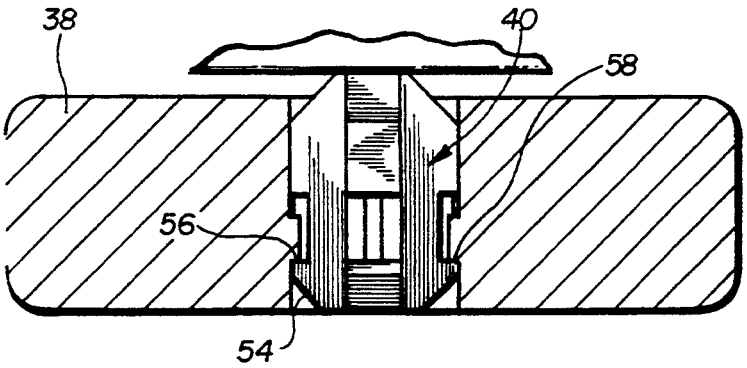
FIG. 12 is an enlarged, fragmentary view of the coupler for the catalyst element of the lower end of the integral cap and lens support structure shown in FIG. 1, on which the catalyst element is mounted.

Referring now to FIGS. 5 and 12, an optional feature of the catalyst mounting coupler 40 includes a conical pilot end 54 serving as a one-way, barbed-like retainer which allows mounting entry through the central bore of a conventional trigon platinum catalyst element 38 but also has an annularly recessed shoulder 56, behind the conical pilot end 54 which snaps against the internal annular ridge 58 of the trigon catalyst bore as shown in FIG. 12. Thus, once assembled, the catalyst 38 cannot be removed. As such, once the catalyst 38 is depleted, the entire lens case can be discarded.

Figure 13:
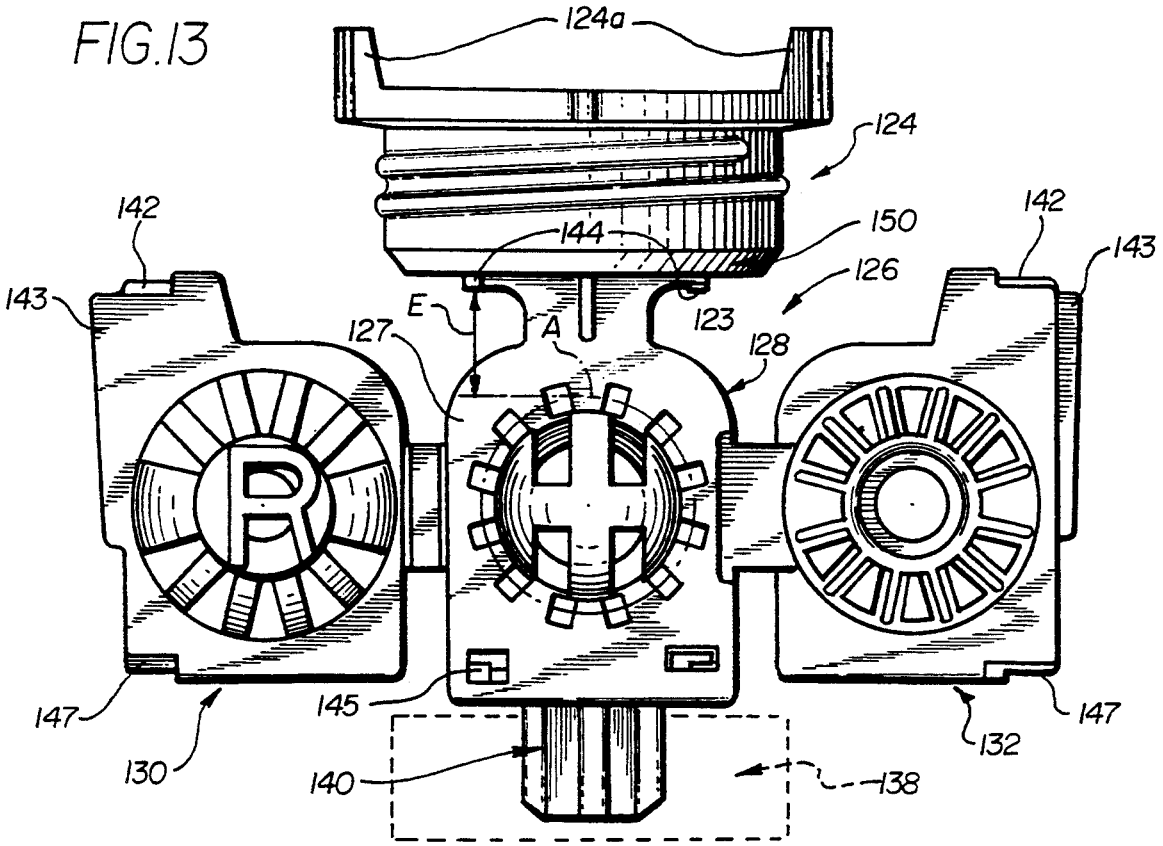
FIG. 13 is a plan view of a second embodiment of an integral cap and lens support structure in accordance with the invention.

Referring to FIG. 13, a second embodiment of the integrally molded cap 124 and lens-supporting basket assembly is generally designated by reference character 126, in accordance with the present invention. The cap 124 and basket assembly 126 can be used with the cup container 12 (FIGS. 1–4) of the first embodiment, and the conical, leading cap seal surface 150 accommodates biting seal by the annular cup edges 46 and 48 as shown in FIGS. 3–4.

In the illustrated embodiment shown in FIG. 13, the cap 124 has a pair of diagonally spaced, upward projections or ears 124a which prevent a user from mistakenly setting an upside-down orientation of the assembled cap 124 and container-cup (12, FIG. 2). Such an inversion of the assembly similar to that shown in FIG. 2 could result in elevation of the mounted catalyst 138, on integral coupler 140, above the surface of the sterilization solution in which case the hydrogen peroxide content might not be fully decomposed to safe concentrations for direct contact of residues on the sterilized lens with the eye of the wearer. Arrangements alternative to the ears 124a may be employed in order to prevent inverted use of the cap 124 during the sterilization process.

Figure 14:
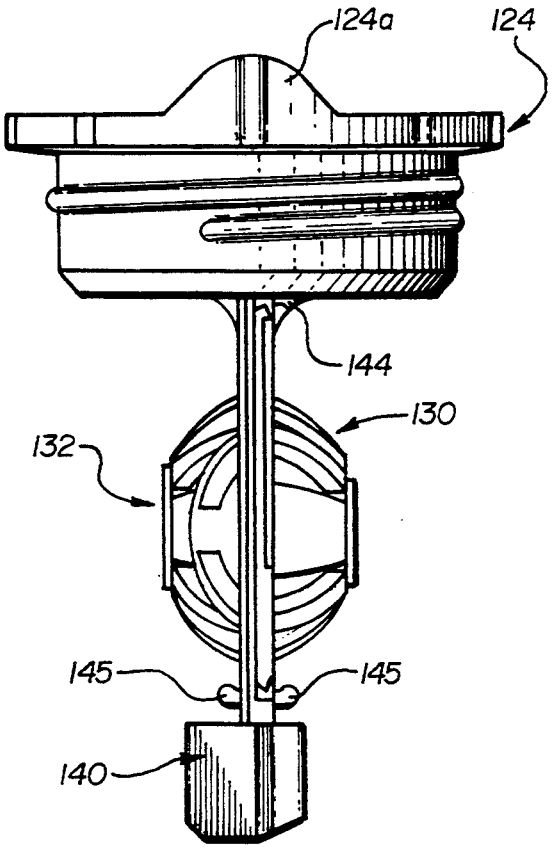
FIG. 14 is a side elevational view of the cap and lens support structure shown in FIG. 13.
Figure 15:
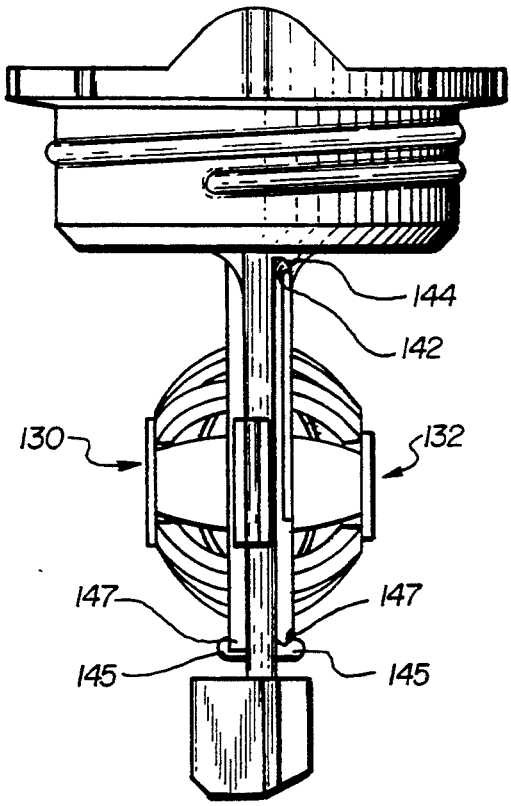
FIG. 15 is a side view similar to FIG. 14 in which basket portions are pivoted and closed against the lens supporting base portion.

In the second embodiment illustrated, the upper latching hooks 144 extend from the bottom surface 160 of the cap 124 as best shown in FIGS. 13 and 16 and are located at the integral joint formed between the cap 124 and the medial stem portion 123 extending to the base plate 128. Each cover member 130 and 132 has a respective upper latch tab 142 which extends upwardly above the level of the lens support surfaces at an elevated spacing indicated by arrow E above the edge of the normally supported location of the lens A, as shown in FIG. 13. This spacing enables the latching and unlatching as illustrated in FIGS. 16 and 17 to take place at the top of the stem 123 and thus is safely remote from the supported lens not only during the latching, but also during either the insertion or removal of the lens from the support structure 126, which reduces any danger of pinching the lens. Each of the cover members 130 and 132 also has a laterally extending finger tab generally adjacent to the respective latch tabs 142, which promote ease of the manual latching. The lower latch hooks 145 and latch tabs 147 are similarly spaced from the supported lens as shown in FIGS. 13–15. Each of the upper and lower hooks 144 and 145 has a sloping configuration in order to lead the surface of misguided lens during removal, smoothly across the hook in order to prevent lens damage by the hook (as earlier described with reference to FIG. 11).

Consequently, the scope of the invention is not limited by any particular embodiment but is defined by the appended claims and the equivalents thereof. For example, the cap 24 can have a venting conduit formed therein (not shown) for release of pressurized gas generated by a lens disinfection process carried out within the lens case as more fully described in U.S. Pat. No. 4,637,919. While particular embodiments of the present invention have been described herein, it will be obvious to those skilled in the art that changes and modifications in various aspects may be made without departing from the broad scope of the invention.

The invention is claimed as follows:

1. A contact lens case comprising: a cup for receiving a quantity of disinfecting or cleaning solution; a cap removably closing an opening mouth of said cup; and a lens support structure for holding a pair of lenses within said cup, said lens support structure comprising a base plate for supporting one of a pair of lenses on each side thereof, a stem arranged between said cap and said base plate, and basket means pivotally connected to said base plate such that the basket means can overlie said base plate on opposite sides in an overlying position thereof to maintain respective contact lenses between said base plate and said respective basket means; and latch means for releasably maintaining said basket means in said overlying position, said latch means comprising a flexible, integral extension peripherally formed on each basket means and releasably retained in snap-fit against a hook member projecting from a joint formed between said cap and stem portion to maintain the basket means in said overlying position with respect to said base plate.

2. A lens case according to claim 1 wherein said lens support structure includes a stem portion arranged between said cap and said base plate, said hook member projecting from said stem portion spaced above said base plate in order to latch said basket on said hook member remotely from said base plate and prevent pinching said lens against said latched hook.

3. A lens case according to claim 1 wherein said integral extension of said latch means is partially defined by a notch on an edge of said basket means.

4. A lens case according to claim 3 wherein said latch means comprises a pair of said integral extensions on respective vertically opposing edges of said basket means for respective snap-fit against a corresponding pair of said hook members.

5. A lens case according to claim 1 wherein said base plate includes at least one projecting support means for a contact lens surface and said hook member includes a proximate surface to said support means which slopes away from said support surface, in order to lead a lens surface smoothly across said hook member if inadvertently the lens is displaced from the support means against said hook member.

6. A lens case according to claim 1 wherein said lens support structure is integrally molded with said cap.

7. A lens case according to claim 1 wherein said basket means is hingedly connected to said base plate at opposed locations by hinges integrally formed therewith.

8. A contact lens case according to claim 1, wherein said cup includes an internally projecting sealing means for biting into the cap in a closed position thereof in order to ensure sealed containment of said solution.

9. A lens case according to claim 8 wherein said seal means comprises a sharp ring annularly biting into said cap.

10. A lens case according to claim 9 wherein said sharp ring is defined by an edge of a shoulder configuration formed on said cup.

11. A lens case according to claim 10 wherein said cup includes a spaced pair of said shoulder edges formed on said cup.

12. A lens case according to claim 9 wherein said sharp ring is arranged to bite into a conical surface formed on said cap.

13. A lens case according to claim 12 wherein said conical portion of said cap is vertically spaced below coupling threads formed on said cap mating with corresponding threads formed on said cup, in order to enable said seal to prevent solution within said cup from contact with said coupling threads subsequent to threaded closure of said cap on said cup.

14. A lens case according to claim 8 wherein said cup comprises a composition of harder material relative to a composition of said cap in order to promote said biting by said seal means integrally formed on said cup.

15. A lens case according to claim 12 wherein said cup composition comprises high density polypropylene and said cap composition comprises low density polypropylene.

16. A contact lens case according to claim 8 wherein said cap has a mold parting line and said sealing means forms a sealing interruption of said mold parting line upon biting into said cap.

17. A contact lens case according to claim 1, wherein said base plate has opposing lens support surfaces for supporting one of a pair of lenses on each respective lens support surface, said base plate being removably contained within said cup, and an annular arrangement of through apertures surrounding said lens support surfaces define a maximum diameter capable of preventing fluid sealing of said lenses against said lens support surfaces.

18. A contact lens case according to claim 1, wherein said lens support structure includes a coupler for mounting a catalyst member thereon, said coupler including a retainer means for preventing removal of said catalyst member from said coupler.

19. A contact lens case according to claim 18 wherein said retainer means comprises a one-way, barbed-like pilot member insertable within an aperture in said catalyst member while preventing withdrawal of said catalyst member therefrom.

20. A lens case according to claim 18, further comprising means for preventing support of the assembled contact lens case upon said cap in an inverted orientation thereof.

21. A lens case according to claim 1, further comprising means for preventing support of the assembled contact lens case upon said cap in an inverted orientation thereof.

22. A lens case according to claim 19 wherein said retainer means further comprises a recess formed adjacent said pilot member for reception of a projection within said catalyst member aperture.

23. A lens case comprising: a cup for receiving a quantity of disinfecting or cleaning solution; a cap removably closing an opening mouth of said cup; and a lens support structure for holding a pair of lenses on each side thereof and basket means pivotally connected to said base plate such that the basket means can overlie said base plate on opposite sides in an overlying position thereof to maintain respective contact lenses between said base plate and said respective basket means; and latch means for releasably maintaining said basket means in said overlying position, said latch means comprising a flexible, integral extension peripherally formed on each basket means and releasably retained in snap-fit against a hook member projecting from a bottom surface of said cap, to maintain the basket means in said overlying position with respect to said base plate.

* * * * *

UNITED STATES PATENT AND TRADEMARK OFFICE

CERTIFICATE OF CORRECTION

PATENT NO. : 5,388,686

DATED : February 14, 1995

INVENTOR(S) : Rowland W. Kanner and Stephen P. Lisak

It is certified that error appears in the above-indentified patent and that said Letters Patent is hereby corrected as shown below:

Column 1, Line 28 "about which" should read
-- about 3% which --

Column 1, Lines 45-46 "contact remnants case" should read
--contact lens case --

Column 2, Line 14 "flash lenses" should read
-- flash remnants --

Column 7, Line 5 "stem arranged" should read
--stem portion arranged --

Signed and Sealed this

Twenty-seventh Day of June, 1995

*Attest:*

Bruce Lehman

BRUCE LEHMAN

*Attesting Officer*

*Commissioner of Patents and Trademarks*